US009103002B2

(12) United States Patent
Decker

(10) Patent No.: US 9,103,002 B2
(45) Date of Patent: Aug. 11, 2015

(54) FATIGUE RESISTANT CAST TITANIUM ALLOY ARTICLES

(75) Inventor: David Decker, Arden, NC (US)

(73) Assignee: BorgWarner Inc., Auburn Hills, MI (US)

( * ) Notice: Subject to any disclaimer, the term of this patent is extended or adjusted under 35 U.S.C. 154(b) by 882 days.

(21) Appl. No.: 13/377,618

(22) PCT Filed: Jun. 24, 2010

(86) PCT No.: PCT/US2010/039752

§ 371 (c)(1), (2), (4) Date: Feb. 29, 2012

(87) PCT Pub. No.: WO2011/008455

PCT Pub. Date: Jan. 20, 2011

(65) Prior Publication Data

US 2012/0148412 A1 Jun. 14, 2012

Related U.S. Application Data

(60) Provisional application No. 61/221,252, filed on Jun. 29, 2009.

(51) Int. Cl.

| | |
|---|---|
| ***B22C 9/04*** | (2006.01) |
| ***C22C 14/00*** | (2006.01) |
| ***F04D 29/28*** | (2006.01) |

(52) U.S. Cl.

CPC . *C22C 14/00* (2013.01); *B22C 9/04* (2013.01); *F04D 29/284* (2013.01)

(58) Field of Classification Search

CPC ..... F01D 5/28; F01D 5/286; F01D 25/005; F05D 2300/17; C22C 14/00; B22D 21/005; B22C 9/04; F04D 29/284

USPC ..... 416/183, 185, 241 R; 415/200; 148/669–671, 421; 420/417–421

See application file for complete search history.

(56) References Cited

U.S. PATENT DOCUMENTS

| | | | |
|---|---|---|---|
| 4,299,626 | A | 11/1981 | Paton et al. |
| 4,705,463 | A | 11/1987 | Joco |

(Continued)

FOREIGN PATENT DOCUMENTS

| | | | |
|---|---|---|---|
| CN | 1737339 | A | 2/2006 |
| CN | 1743482 | A | 3/2006 |

(Continued)

OTHER PUBLICATIONS

Chinese Office Action dated Feb. 21, 2013; Application SN:201080026049.4; Applicant:BorgWarner Inc.; 14 pages.

(Continued)

*Primary Examiner* — Nathaniel Wiehe
*Assistant Examiner* — Woody A Lee, Jr.
(74) *Attorney, Agent, or Firm* — BrooksGroup

(57) ABSTRACT

Articles that are cast from a particular titanium alloy can achieve a relatively high fatigue strength. The titanium alloy is an ($\alpha$+$\beta$) titanium alloy that has a nominal composition of about 5.5 to about 6.63 mass percent aluminum, about 3.5 to about 4.5 mass percent vanadium, about 1.0 to about 2.5 mass percent chromium, maximum of 0.50 mass percent iron, about 0.15 to about 0.25 mass percent oxygen, about 0.06 to about 0.12 mass percent silicon, and at least 80 mass percent titanium or the balance titanium (Ti) with the exception of some allowable impurities. In one exemplary application, this titanium alloy may be used to cast a turbocharger compressor wheel.

17 Claims, 4 Drawing Sheets

(56) References Cited

U.S. PATENT DOCUMENTS

| | | | | |
|---|---|---|---|---|
| 4,850,802 | A | 7/1989 | Pankratz et al. | |
| 5,193,969 | A | 3/1993 | Fieury et al. | |
| 5,399,212 | A * | 3/1995 | Chakrabarti et al. | 148/421 |
| 5,503,798 | A * | 4/1996 | Singheiser et al. | 420/420 |
| 5,778,963 | A | 7/1998 | Parrille et al. | |
| 5,795,413 | A | 8/1998 | Gorman | |
| 5,861,070 | A * | 1/1999 | Reichman et al. | 148/671 |
| 6,164,931 | A | 12/2000 | Norton et al. | |
| 6,629,556 | B2 | 10/2003 | Decker et al. | |
| 6,663,347 | B2 | 12/2003 | Decker et al. | |
| 6,726,422 | B2 * | 4/2004 | Giannakakos | 411/438 |
| 6,904,949 | B2 | 6/2005 | Decker et al. | |
| 6,918,974 | B2 | 7/2005 | Woodfield | |
| 7,008,491 | B2 | 3/2006 | Woodfield | |
| 2006/0045789 | A1 | 3/2006 | Nasserafi et al. | |
| 2006/0068214 | A1 | 3/2006 | Gigliotti et al. | |
| 2007/0102073 | A1 | 5/2007 | Veeck et al. | |
| 2007/0131314 | A1 | 6/2007 | Kuroda | |

FOREIGN PATENT DOCUMENTS

| | | | |
|---|---|---|---|
| CN | 177792 | A | 4/2006 |
| CN | 1954087 | A | 4/2007 |
| JP | 20080502808 | A | 1/2008 |

OTHER PUBLICATIONS

Investment Casting ; http://en.wikipedia.org/wiki/Investment_casting ; 4 pages.
Hot isostaic pressing ; http://en.wikipedia.org/wiki/Hot_Isostatic_Pressing ; 1 page.
Annealing (metallurgy) ; http://en.wikipedia.org/wiki/Annealing_(metallurgy) ; 4 pages.
Metallurgical Consultants Titanium ; http://www.materialsengineer.com/E-Titanium.htm ; 3 pages.
Turbocharger ; http://en.wikipedia.org/wiki/Turbocharger ; 16 pages.
Turbochargers 101 ; http://www.turbominivan.com/tech/turbo101.htm ; 4 pages.
Turbochargers 201 ; http://www.turbominivan.com/tech/turbo201.htm ; 7 pages.
Titanium and Titanium Alloys ; http://www.key-to-metals.com/Article20.htm ; 5 pages.
Titanium Alloys-Alpha Beta and Alpha-Beta Alloys ;http://www.azom.com/details.asp?ArticleID=915 ; 9 pages.
Fatigue crack propagation in titanium alloys with lamellar and bi-lamellar microstructures ; G.Schroeder. J. Albrecht.G Luetjering ; Materials Science and Engineering A319-321 (2001) 602-606 ; www.elsevier.com/locate/msea.
Data Sheet on FS-2S material published by FS Precision Tech.

* cited by examiner

FATIGUE RESISTANT CAST TITANIUM ALLOY ARTICLES

This application claims the benefit of U.S. Provisional Application Ser. No. 61/221,252 filed Jun. 29, 2009.

FIELD OF THE INVENTION

The field to which the disclosure generally relates includes titanium alloys, methods of forming titanium alloys, and products formed from titanium alloys.

BACKGROUND

Titanium alloys have become quite popular for use in normal and demanding applications because of their high strength-to-weight ratio, excellent mechanical properties, and relatively high corrosion resistance. But experience has shown that titanium alloys in wrought form—for example, those that are forged or milled from bar stock—generally exhibit greater fatigue strength than when they are formed by other shape technologies such as casting or powder metallurgy. It may thus be beneficial to identify titanium alloys and procedures for casting those alloys such that the finished cast article replicates or at least favorably compares to the fatigue behavior of the same article in wrought form.

SUMMARY OF EXEMPLARY EMBODIMENTS OF THE INVENTION

One exemplary embodiment of the invention may include a product comprising a compressor wheel that has been heated treated with a rapid quench for use in a vehicle turbocharger that compresses air and supplies it to an intake manifold of an internal combustion engine. The compressor may be composed of a cast titanium alloy that has a nominal composition comprising about 5.5 to 6.63 mass percent aluminum, about 3.5 to 4.5 mass percent vanadium, about 1.0 to about 2.5 mass percent chromium, maximum of 0.50 mass percent iron, about 0.06 to about 0.12 mass percent silicon, maximum 0.5 weight percent N, maximum of 0.015 weight percent H, maximum of 0.15 weight percent C, and at least 80 mass percent or the balance titanium.

Another exemplary embodiment of the invention may include a product comprising a compressor wheel for a vehicle turbocharger comprising a hub, a base, and a plurality of aerodynamically contoured blades. The compressor wheel having been heat treated with a rapid quench and having a nominal composition of about 5.5 to 6.63 mass percent aluminum, about 3.5 to 4.5 mass percent vanadium, about 1.0 to about 2.5 mass percent chromium, about 0.06 to about 0.12 mass percent silicon, and at least 80 mass percent or the balance titanium. The compressor wheel may also have a microstructure comprising a bi-lamellar distribution of primary $\alpha$ platelets and secondary $\alpha$ platelets in a $\beta$ lamellae matrix.

Another exemplary embodiment of the invention may include a product made by the steps which comprise investment casting an article of predetermined shape using a titanium alloy that has a nominal composition of about 5.5 to 6.63 mass percent aluminum, about 3.5 to 4.5 mass percent vanadium, about 1.0 to about 2.5 mass percent chromium, maximum of 0.50 mass percent iron, about 0.06 to about 0.12 mass percent silicon, and at least 80 mass percent or the balance titanium, hot isostatic pressing the article, heating the article, rapidly quenching the article, and annealing the article.

Another exemplary embodiment of the invention may include a method comprising casting a turbocharger compressor wheel that comprises a hub, a base, and a plurality of aerodynamically contoured blades using a titanium alloy that has a nominal composition comprising about 5.5 to 6.63, or 3.5 to less than 6.0 mass percent aluminum, about 3.5 to 4.5 mass percent vanadium, about 1.0 to about 2.5 mass percent chromium, maximum of 0.50 mass percent iron, about 0.06 to about 0.12 mass percent silicon, and at least 80 mass percent or the balance titanium. The method may also include heating the cast compressor wheel to a temperature above the $\beta$-transus temperature of the titanium alloy so that the compressor wheel has a substantially $\beta$-phase crystal microstructure. Furthermore, the method may include rapidly cooling the compressor wheel from a temperature above the $\beta$-transus temperature of the titanium alloy to a temperature below the $\beta$-transus temperature at a cooling rate sufficient to provide the compressor wheel with a bi-lammellar microstructure that comprises primary $\alpha$ platelets and secondary $\alpha$ platelets in a $\beta$ lamellae matrix.

Other exemplary embodiments of the present invention will become apparent from the detailed description provided hereinafter. It should be understood that the detailed description and specific examples, while indicating the exemplary embodiment(s) of the invention, are intended for purposes of illustration only and are not intended to limit the scope of the invention.

BRIEF DESCRIPTION OF THE DRAWINGS

Exemplary embodiments of the present invention will become more fully understood from the detailed description and the accompanying drawings, wherein.

DETAILED DESCRIPTION OF EXEMPLARY EMBODIMENTS

The following description of the embodiment(s) is merely exemplary in nature and is in no way intended to limit the invention, its application, or uses.

The fatigue strength of certain wrought titanium alloy articles allows them to be used for many demanding applications such as those that encounter, among others, high stresses, harsh environments and elevated temperatures. But sometimes articles having relatively complex shapes or surface contours are not amenable to formation in wrought form. This is usually so because the article's intricate shape cannot be precisely fabricated within acceptable tolerances, or because the time and monetary investments required to do so are unacceptably high. The use of casting techniques, however, can alleviate some of the hardships associated with forming articles that have complicated shapes. But as touched upon before, the fatigue strength of cast titanium alloy articles is generally not as prominent as its wrought counterpart.

Figure 5:
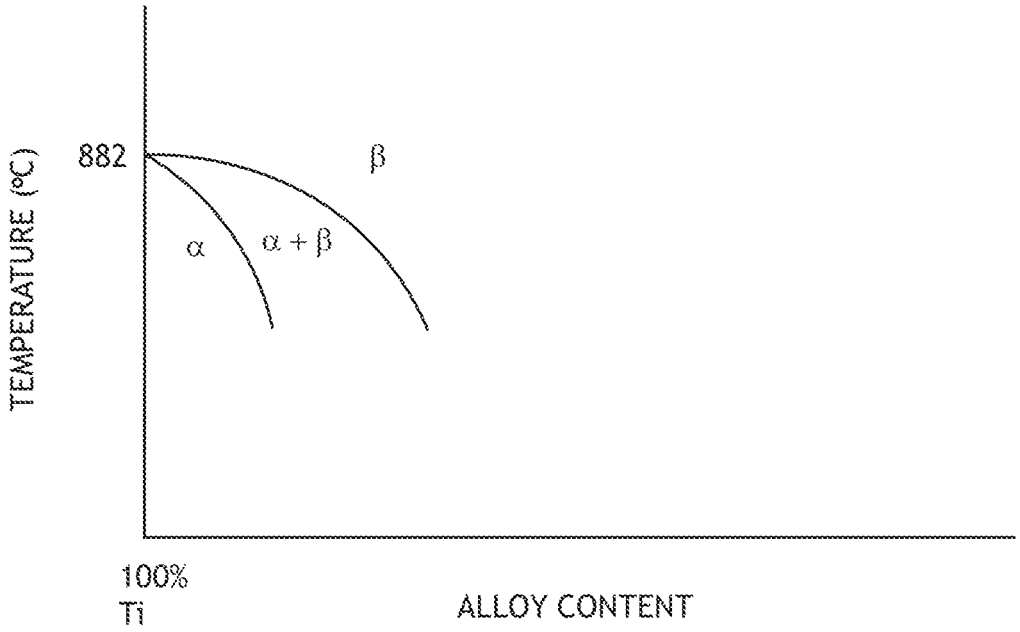
FIG. 5 is a schematic representation of a the relevant portion of the equilibrium phase diagram of a titanium alloy according to one embodiment of the invention.

A particular titanium alloy has been identified that can overcome these and other related issues. This titanium alloy (hereafter referred to as TiAl6V4Cr2 for brevity) has a nominal composition of about 5.5 to about 6.63, mass percent aluminum (Al), about 3.0 to about 4.5 mass percent vanadium (V), about 1.0 to about 2.5 mass percent chromium (Cr), about maximum of 0.50 mass percent iron (Fe), about 0.15 to about 0.25 mass percent oxygen (O), about 0.06 to about 0.12 mass percent silicon (Si), and the at least 80 mass percent or the balance titanium (Ti) with the exception of some allowable impurities. Most notably, these impurities can include a maximum of 0.08 mass percent carbon (C), a maximum of 0.04 mass percent manganese (Mn), a maximum of 0.04 mass percent nitrogen (N), and a maximum of 0.015 mass percent hydrogen (H). In one embodiment the amount of TI in the alloy may range from 85.405-89.79 mass percent. This titanium alloy is considered a relatively beta rich $\alpha+\beta$ titanium alloy from ambient temperatures to at least 370° C. in part because of the beta stabilizing effects of vanadium ($\beta$-isomorphous element) and chromium (sluggish $\beta$-eutectoid element). A schematic representation of the relevant portion of the equilibrium phase diagram of TiAl6V4Cr2 is illustrated in FIG. 5. Tests and analysis also indicate that TiAl6V4Cr2 can be cast into articles—of either simple or complex shape—that exhibit a relatively high fatigue strength. For instance, such TiAl6V4Cr2 cast articles can replicate the fatigue behavior of similar wrought TiAl6V4 articles in that both kinds of articles exceed many threshold service requirements for high cycle fatigue resistance.

Without being bound by theory, it is believed a particular microstructure is responsible for providing the cast TiAl6V4Cr2 articles with such a relatively high fatigue strength property. This microstructure can be described as a bi-lamellar distribution of primary and secondary $\alpha$ platelets (hexagonal close-packed crystal phase) in a $\beta$ lamellae matrix (body centered cubic crystal phase). The primary $\alpha$ platelets resemble relatively large and lengthy "needle-like" grains. The secondary $\alpha$ platelets, however, are smaller fine-sized grains that are randomly distributed between the larger $\alpha$ platelets throughout the $\beta$ lamellae matrix. These secondary $\alpha$ platelets may serve a number of helpful functions. For instance, they can harden the $\beta$ lamellae matrix which in turn can reduce the effective slip length across the $\alpha$ colonies and also create relatively effective barriers to microcrack propagation. As such, it may be feasible to utilize articles cast from TiAl6V4Cr2 by known casting techniques in applications often reserved for Ti6Al4V and other substantially fatigue resistant wrought titanium alloy articles.

The alloy article may be prepared from relatively pure metal components or scrap Ti6Al4V may be reheated with the addition of chrome and silicon and other elements as desired. The metals, scrap material and additional elements may be heated in a variety of ways including, but not limited to, gas or electric furnaces, or by vacuum arc remelting. Cast articles may be made by a variety of methods including, but not limited to, vacuum with centrifugal assist or by gravity casting in a vacuum.

The bi-lamellar microstructure just described can be formed by rapidly cooling the cast TiAl6V4Cr2 article from a temperature above its $\beta$ transus temperature to a temperature within its $\alpha+\beta$ phase field. Suitable rapid cooling techniques include, but are not limited to, water quenching and high pressure argon cooling. It should be noted that the cast article may be subjected to a variety of treatments both before an after it is rapidly cooled. For example, the cast article may be subjected to hot isostatic pressing before rapid cooling to harden the cast article by reducing its internal porosity. Also, the cast article may be annealed following rapid cooling to remove any internal stresses that may be caused by crystal defects such as dislocations. Persons skilled in the art of casting will know and understand the various procedures involved in casting a wide range of articles, as well as the process parameters for these procedures or how to derive these parameters, such that a detailed explanation of the many different casting techniques and the many different treatments that may be performed before and after the rapid cooling procedure is not necessary here.

Figure 1:
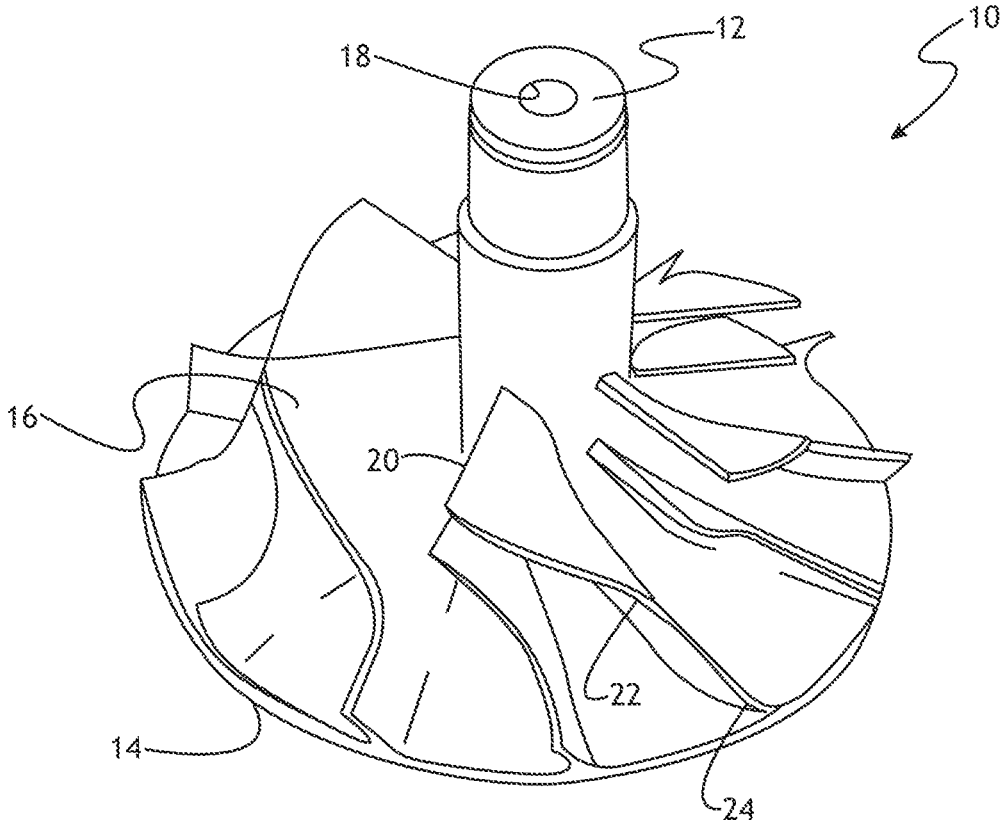
FIG. 1 is a compressor wheel for a vehicle turbocharger according to one embodiment of the invention.

Referring now to FIGS. 1-4, there is shown a specific and exemplary embodiment of an article cast from TiAl6V4Cr2 that exhibits the bi-lamellar microstructure previously mentioned. For example, as shown in FIG. 1, the cast article may be a compressor wheel 10 for use in a vehicle turbocharger to help compress fresh air and supply it at an increased pressure to an intake manifold of the vehicle's internal combustion engine. This increased air pressure in the intake manifold allows greater air volumes to be drawn into the engine's cylinders through associated intake valves for combustion with a correspondingly increased amount of fuel; the result being a boost in the power and torque output of the vehicle's internal combustion engine.

In a typical turbocharger arrangement, the compressor wheel 10 is enclosed in a compressor housing and mounted to one end of a rotatable shaft (not shown). The compressor wheel, as shown in FIG. 1, generally includes a hub 12, a base 14, and plurality of aerodynamically contoured blades 16. The hub 12 may be annular in shape so as to define an axial bore 18 for receiving the rotatable shaft that ultimately drives the compressor wheel 10. The base 14 may be located axially opposite from the hub 12 and may be disc-shaped and larger in diameter. The hub 12 and the base 14 may be integrally connected; that is, the hub 12 transitions into the base 14 by expanding radially outwardly in a fluted or angled manner along the axial length of the compressor wheel 10. The plurality of aerodynamically contoured blades 16 may project outwards and wrap slightly circumferentially around the transition between the hub 12 and the base 14. They may also exhibit a precise and complex curvature that generally follows an "S-shaped" contour beginning near the hub 12 and ending near the base 14. This curvature is designed to accomplish at least several objectives when the compressor wheel 10 is rotating. First, a leading edge 20 of each blade 16 grabs incoming air and moves it axially towards the base 14 of the compressor wheel 10. Second, an intermediate portion 22 of each blade 16 changes the direction of the air flow from axial to radial and at the same time accelerates that air circumferentially around the compressor wheel 10 at high speeds. Finally, a trailing edge 24 of each blade 16 propels air out of the compressor wheel 10 at an increased pressure. This high-pressure air flow is then delivered either directly or indirectly to the intake manifold depending on whether or not the air first passes through an intercooler. It should be noted at this point that the compressor wheel 10 shown in FIG. 1 is subject to many design modifications that may be undertaken by skilled artisans and, thus, alternative configurations are possible. For example, as explained in commonly assigned U.S. Pat. No. 6,904,949, the compressor wheel shown in FIG. 1 is designed in part to help improve its castability. Many other compressor wheel designs, however, are amenable to formation through a variety of known casting techniques.

To rotate the compressor wheel so that in can function in this manner, a turbine wheel enclosed in a turbine housing may be mounted on the opposite end of the rotating shaft. An engine exhaust gas flow may be controllably fed to the turbine housing where it is caught by the turbine wheel causing it to rotate at speeds of about 80,000 to 250,000 RPM in order for the hot exhaust gas to escape from the turbine housing and continue flowing through the vehicle's exhaust system. The speed of the turbine wheel may be controlled by a wastegate actuator which allows part of the exhaust gas flow to bypass the turbine housing when the air pressure in the intake manifold reaches a preset maximum. Moreover, the rotatable shaft that connects the compressor wheel 10 and the turbine may be suspended by a bearing system, such as fluid lubricant bearing system, to allow the shaft to rotate at these relatively high speeds with minimal energy losses due to friction.

Figure 2:
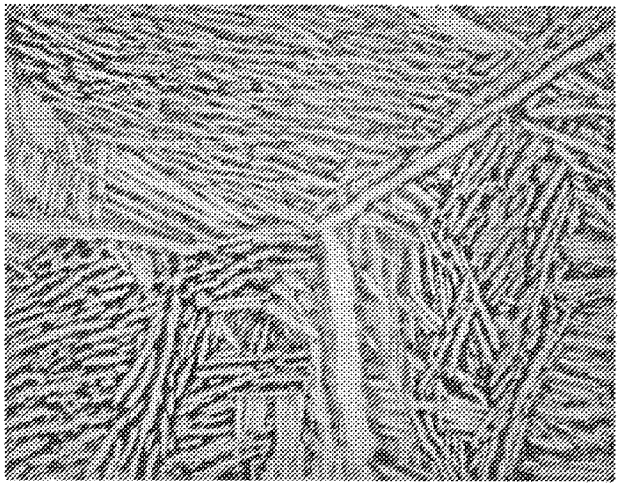
FIG. 2 is a photomicrograph that shows the microstructure of a cross-sectional cut of the hub of the compressor wheel of FIG. 1
Figure 3:
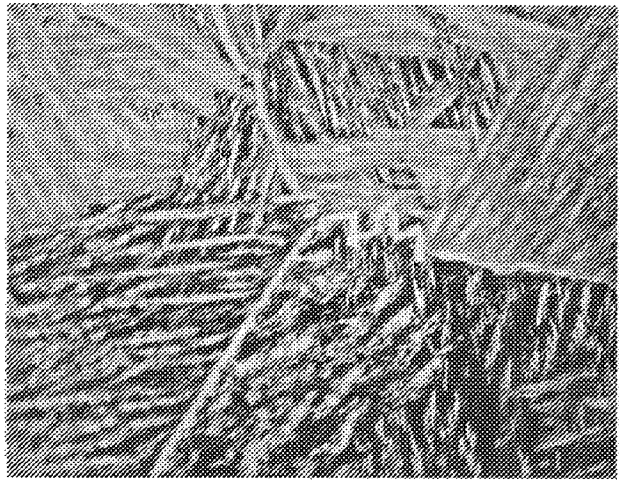
FIG. 3 is a photomicrograph that shows the microstructure of a cross-sectional cut of one of the blade of the compressor wheel of FIG. 1.

Referring now to FIGS. 2 and 3, the bi-lamellar microstructure of the cast TiAl6V4Cr2 compressor wheel 10 can be seen. FIG. 2, which is a photomicrograph of the hub 12 in cross-section and magnified 500 times, shows the β lamellae (the darker-colored matrix), the primary α platelets (the lighter-colored and longer needle-like pieces), and the secondary α platelets (the smaller lighter-colored specks or fragments) distributed between the primary α platelets. FIG. 3, which is photomicrograph of one of the aerodynamically contoured blades 16 in cross-section and also magnified 500 times, shows a bi-lamellar microstructure similar to that found in the hub 12. Certain mechanical and fatigue strength properties may also indicate that the compressor wheel 10 has achieved the bi-lamellar microstructure shown in FIGS. 2 and 3 in the event that microscopic images of the wheel's 10 microstructure cannot be obtained.

The mechanical properties associated with the bi-lamellar microstructure of FIGS. 2 and 3 are shown below in Table 1. These properties correspond to the ASTM E 8 procedure (Standard Test Methods of Tension Testing of Metallic Materials) performed on a round specimen of two inch gage length.

TABLE 1

| Mechanical Properties | | |
|---|---|---|
| Tensile Strength | $R_m$[MPa][1)] | min. 980 |
| Yield Strength (offset 0.2%) | $R_{p0.2}$[MPa][1)] | min. 890 |
| Elongation | A [%] | min. 10 |

[1)] 1 MPa = N/mm$^2$

Similarly, the fatigue strength properties shown below in Table 2 should be obtainable if the compressor wheel 10 possesses the bi-lamellar microstructure of FIGS. 2 and 3. These properties correspond to a procedure where representative axial fatigue cast bars are randomly selected and cyclically loaded to 670723 MPa maximum (R=0.1) at 150° C., and then fatigue tested according to ASTM E 466 (Standard Practice for Conducting Force Controlled Constant Amplitude Axial Fatigue Tests of Metallic Materials). The median life property is calculated from a sample of at least ten bars, and the B1 life is determined by extrapolation using a Weibull curve.

TABLE 2

| Fatigue Strength | | |
|---|---|---|
| Medium Life | Cycles | 50,000 |
| B1 Life Extrapolated | Cycles | min. 12500 |

Figure 4:
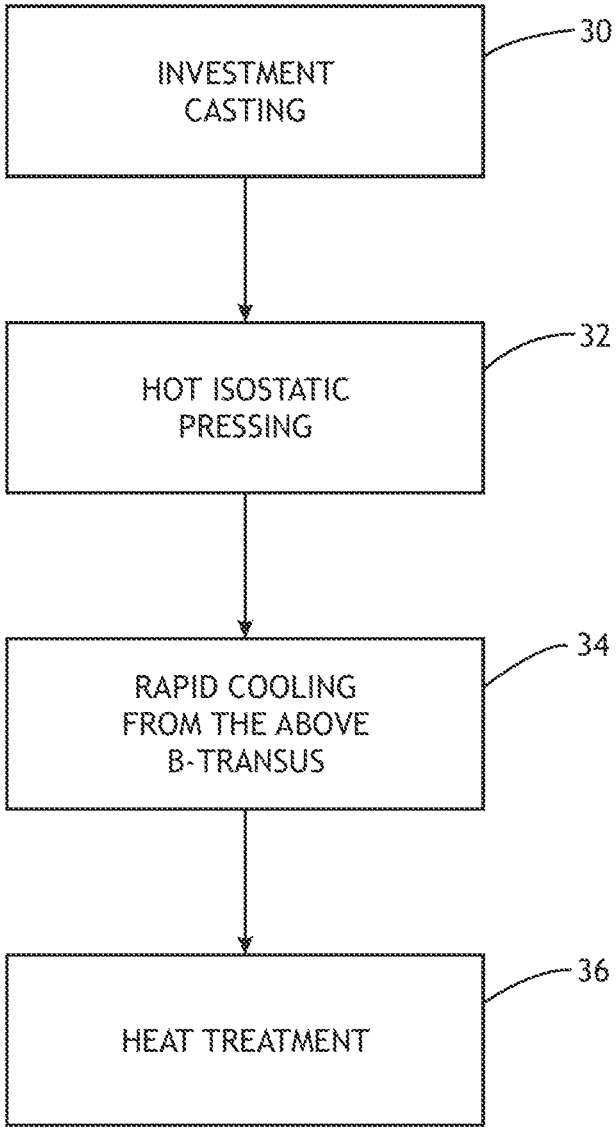
FIG. 4 is flowchart depicting some of the steps for forming the compressor wheel of FIG. 1.

Referring now to FIG. 4, there is diagramed one embodiment of a manufacturing procedure that can be used to make the compressor wheel 10. This procedure may include an investment casting step 30, a hot isostatic pressing (HIP) step 32, a rapid cooling step 34, and an annealing step 36.

The investment casting step 30 may be a conventional titanium alloy investment casting procedure. Such a procedure generally involves, at the outset, constructing a positive wax pattern that is identical or nearly identical in size and surface geometry to the compressor wheel 10. This can be accomplished by injection molding an appropriate molten or semisolid wax composition into a metal die cavity that may include one or more die inserts that define the precise shape and surface detail of the wax pattern and any pregating connections. The cavity may also include and one or more preformed ceramic cores that allow for the formation of any necessary internal passages such as that of the axial bore 18. Then, after the wax solidifies, the die inserts are extracted from the die cavity and the hardened positive wax pattern is removed. A positive wax pattern of this kind may also be constructed by individually forming distinct parts of the wax pattern and then subsequently assembling and fusing them together. The hardened wax pattern may now be attached to a feeder device—such as a runner, a spure, or a custom designed feeder—that includes a pouring basin and a suitable gating system for the subsequent delivery of molten TiAl5V4Cr2, as will be discussed below. More than one positive compressor wheel wax pattern may be attached to the feeder system, if desired.

A refractory-based coating mold (hereafter coating mold) may now be formed around the outer surface contour of the wax pattern. This may be achieved by first dipping or otherwise exposing the wax pattern, and most likely a portion of the feeder device, into an appropriate ceramic slurry. The wax pattern may then be removed from the ceramic slurry and drained of excess slurry drag-out. Next, the ceramic-slurry-wetted surface of the wax pattern may be stuccoed with a granulated refractory material by sprinkling, immersion in a fluidized bed, or by some other known technique, and then air dried or cured to form a first layer of the coating mold. This process of alternately dipping, stuccoeing, and drying/curing the wax pattern may be repeated until the coating mold overlying the wax pattern has attained a predetermined thickness. The granulated refractory material utilized for each coating application may also transition from a relatively fine material to a relatively coarser material so that the inner surface of the coating mold, and thus the outer surface of the cast compressor wheel 10, is suitable smooth.

The positive wax pattern may now be removed from its overlying coating mold by one of a variety of dewaxing procedures. For example, a flash dewaxing procedure may be utilized in which the wax pattern with its overlying coating mold is introduced into a gas-fired furnace that can generate relatively high temperatures. In another example, an autoclave dewaxing procedure may be utilized in which the wax pattern and its overlying coating mold is introduced into a steam autoclave apparatus that simultaneous applies heat energy and an external pressure to the coated wax pattern. The coating mold that remains after dewaxing may then be fired at a high temperature sufficient to cure and harden the coating mold into a ceramic shell that is an exact or close-to-exact negative pattern of the compressor wheel 10 and capable of withstanding the stresses associated with receiving a molten TiAl6V4Cr2 charge. The firing of the coating mold into the ceramic shell also burns away any wax residues that were not removed during dewaxing. The ceramic shell may then be preheated in anticipation or receiving the molten TiAl6V4Cr2. Such preheating may be useful in preventing thermal shock damage to the ceramic shell as a result of large temperature differences between the shell and the molten TiAl6V4Cr2. A gas fired furnace may be used for firing and preheating procedures just described. In fact, if desired, a single multi-zone continuous gas fired furnace may be utilized to first dewax the ceramic shell mold coating, then fire the ceramic shell mold into a ceramic shell, and finally preheat the ceramic shell by progressing those objects through temperature-controlled furnace zones of increasing temperature.

The ceramic shell, which is still attached to the feeder system, may now be filled with molten TiAl6V4Cr2. This may occur by melting pre-alloyed ingots of TiAl6V4Cr2 and then vacuum-assist pouring a charge of the molten TiAl6V4Cr2 into the pouring basin of the feeder system so that the molten alloy flows through the gating system and into the ceramic shell. The use of vacuum-assist pouring to evacuate air from the ceramic shell before pouring helps prevent the occurrence of unwanted chemical reactions that may occur between air and molten titanium while at the same time minimizing flow resistance through the shell. The molten TiAl6V4Cr2 is then allowed to cool and settle. Afterwards, the ceramic shell is removed to expose the cast TiAl6V4Cr2 compressor wheel 10. Removal of the ceramic shell may be facilitated by a number of techniques such as vibratory hammering, pressurized water blasting, grit blasting, or chemical dissolution. The preformed ceramic cores that were originally included in the positive wax pattern may then be removed from the compressor wheel 10 by mechanical knockout procedures such as vibration, chipping, and abrasive blasting, by chemical leaching in solutions such as anhydrous molten sodium hydroxide or hydrochloric acid, or by a combination of mechanical knockout and chemical leaching procedures. The gating connections may also be removed from the compressor wheel 10 at this time with a band saw, abrasive wheel, and/or by dipping them in liquid nitrogen and removing them with a hammer or chisel. Additional machining such as belt grinding may then be utilized to complete the removal of the gating connections within applicable dimensional tolerances.

The cast TiAl6V4Cr2 compressor wheel 10 may now be subjected to the HIP step 32 to harden the wheel 10. Such a procedure generally involves simultaneously exposing the compressor wheel 10 to heat and an isostatic gas pressure (equal in all directions) in a high pressure containment vessel. Argon gas is commonly used as the pressurized gas because of its chemically inert nature. The heat and gas pressure applied to the compressor wheel 10 during the HIP step 32 reduces, and to some extent practically eliminates, any significant internal voids and microporosity that may have been formed in the wheel 10 as it cooled and solidified during the investment casting step 30. The mechanism by which the compressor wheel 10 hardens is generally considered as some combination of plastic deformation, creep, and metallurgical diffusion bonding. A set of HIP conditions capable of achieving these mechanical alterations in the cast TiAl6V4Cr2 compressor wheel 10 may be a treatment time of about two to about four hours at 899±14° C. or 954±14° C. at a pressure not less than 1000 bar. After the application of heat and pressure, the compressor wheel 10 may be allowed to cool into its newly hardened state.

The compressor wheel 10 may now be rapidly cooled, as depicted in step 34 of FIG. 4, to provide it with the bi-lamellar microstructure shown in FIGS. 2 and 3. To carry out this rapid cooling step 34 the compressor wheel 10 may first be heated in a gas-fired furnace to a temperature above its β-transus temperature; that is, it may be heated to a temperature above that at which TiAl6V4Cr2 undergoes a crystallographic transformation from its α+β phase to its β phase. A representation of the β-transus temperature is shown schematically in FIG. 5 as the line that separates the α+β phase field and the β phase field. This temperature, as can be seen, is dependent on the alloy content of TiAl6V4Cr2, and its slope may even fluctuate depending on the presence of greater or lesser amounts of a particular alloying element. Nevertheless, for purposes of the rapid cooling step 34, FIG. 5 provides a fairly representative graphical illustration of the equilibrium phase diagram of TiAl6V4Cr2. The heating of the compressor wheel 10 to a temperature above its β-transus temperature may thus be accomplished without knowing or identifying the exact β-transus temperature that must be eclipsed. This is so because the β-transus temperature of pure titanium (crystallographic transformation from its α phase to its β phase) is known to be approximately 882° C.; a temperature that, as shown in FIG. 5, is greater than the β-transus temperature of TiAl6V4Cr2 due to the beta stabilizing effects of some of its alloying components. Thus, the compressor wheel 10 may be heated in the gas-fired furnace until it achieves a uniform easily above the β-transus temperature of TiAl6V4Cr2 and may thus be an appropriate temperature from which to rapidly cool the compressor wheel 10.

After achieving a temperature above its β-transus temperature, the compressor wheel 10 may now be rapidly cooled to a temperature within its α+β phase field. This may be accomplished by purging the gas fired furnace that still houses the hot compressor wheel 10 with a high pressure argon gas flow that is introduced at an ambient or slightly below ambient temperature. It may also be possible to rapidly cool the compressor wheel 10 by removing it from the gas-fired furnace and water quenching it. But no matter what procedure is used to rapidly cool the compressor wheel 10—whether by argon purging, water quenching or some other procedure—the objective of the rapid cooing step 34 is to cool the compressor wheel 10 at a rate considerably faster than that achievable by simply allowing the wheel 10 to cool in air (i.e., normal furnace cooling or air cooling). In some circumstances the exact cooling rate of the rapid cooling step 34 may not need to be known. Instead, an examination of the compressor wheel's 10 microstructure and physical properties following rapid cooling can be informative as to whether or not it was cooled fast enough. For if the compressor wheel 10 exhibits the bi-lamellar microstructure shown in FIGS. 2 and 3, or the mechanical properties shown in Table 1 and the fatigue strength properties shown in Table 2, or both the microstructure and the physical properties, then the cooling rate during the rapid cooling step 34 was sufficient. But on the other hand, if the compressor wheel 10 exhibits a fully lamellar microstructure or some other microstructure besides that shown in FIGS. 2 and 3, or does not meet the mechanical properties of Table 1 or the fatigue strength properties shown in Table 2, than the cooling rate during the rapid cooling step 34 was likely too slow.

Following the rapid cooling step 34, the compressor wheel 10 may be heat treated as depicted in step 36 to remove any internal stresses that it may have acquired while being manufactured. This may involve stress relieving and annealing the compressor wheel 10 at a temperature in the α+β phase field so as to eliminate or reduce internal stresses such as dislocations and lattice vacancy gradients while at the same time not jeopardizing the bi-lamellar microstructure achieved during the rapid cooling step 34. A set of conditions that may be utilized in heat treatment step 36 may therefore include annealing the compressor wheel at about 550° C. for eight hours in a furnace equipped for vacuum annealing. After this annealing period the compressor wheel may be air or furnace cooled to ambient temperature.

The compressor wheel 10 may now be examined to ensure that it possesses the appropriate bi-lamellar microstructure and/or the mechanical and fatigue strength properties associated with such a bi-lamellar microstructure. After such an examination the compressor wheel 10 may be finished and ultimately assembled as part of a vehicle turbocharger.

The above description of embodiments of the invention is merely exemplary in nature and, thus, variations thereof are not to be regarded as a departure from the spirit and scope of the invention.

What is claimed is:

1. A product comprising:

a heat treated and rapidly quenched compressor wheel for a vehicle turbocharger comprising a hub, a base, and a plurality of aerodynamically contoured blades, the compressor wheel having a nominal composition of about 5.5 to 6.63 mass percent aluminum, about 3.5 to 4.5 mass percent vanadium, about 1.0 to about 2.5 mass percent chromium, maximum of 0.50 mass percent iron, about 0.06 to about 0.12 mass percent silicon, at least 80 mass percent titanium, impurities of up to about 0.08 mass percent carbon, up to about 0.08 mass percent manganese, up to about 0.04 mass percent nitrogen, and up to about 0.013 mass percent hydrogen; and wherein the compressor wheel has a microstructure comprising a bi-lamellar distribution of primary α platelets and secondary α platelets in a β lamellae matrix.

2. The product of claim 1, wherein the compressor wheel comprises a minimum tensile strength of about 980 MPa, a minimum yield strength of about 880 MPa when measured at a 0.2% offset, and a minimum elongation of about 8 percent.

3. The product of claim 1, wherein the hub defines an axial bore that receives one end of a shaft, the other end of the shaft being received by a turbine wheel, at least a portion of the turbine wheel being situated in an engine exhaust gas flow to cause the turbine wheel and the compressor wheel to rotate.

4. A product made by the steps which comprise:

investment casting an article of predetermined shape using a titanium alloy that has a nominal composition of about 5.5 to 6.63 mass percent aluminum, about 3.5 to 4.5 mass percent vanadium, about 1.0 to about 2.5 mass percent chromium, maximum of mass percent iron, about 0.06 to about 0.12 mass percent silicon, and at least 80 mass percent titanium;

hot isostatic pressing the article at a predetermined temperature and pressure for a predetermined time period;

heating the article to a temperature above the β-transus temperature associated with the titanium alloy;

cooling rapidly the article from the temperature above the β-transus temperature to a temperature below the β-transus temperature and within the α+β phase field associated with the titanium alloy; and annealing the article at a temperature within the α+β phase field associated with the titanium alloy.

5. The product of claim 4, wherein the hot isostatic pressing step comprises hot isostatic pressing the article for about two to about four hours at a temperature of about 885° C. to about 913° C. at a pressure of not less than 1000 bar.

6. The product of claim 4, wherein the hot isostatic pressing step comprises hot isostatic pressing the article for about two to about four hours at a temperature of about 940° C. to about 968° C. at a pressure of not less than 1000 bar.

7. The product of claim 4, wherein the cooling rapidly step comprises cooling the article at a cooling rate sufficient to provide the article with a bi-lammellar microstructure that comprises primary α platelets and secondary α platelets in a β lamellae matrix.

8. The product of claim 4, wherein the annealing step comprises annealing the article at about 550° C. for about eight hours.

9. The product of claim 4, wherein the article, following the cooling rapidly step, comprises a minimum tensile strength of about 980 MPa, a minimum yield strength of about 890 MPa when measured at a 0.2% offset, and a minimum elongation of about 8 percent.

10. A product comprising:

a heat treated and rapidly quenched compressor wheel for use in a vehicle turbocharger that compresses air and supplies it to an intake manifold of an internal combustion engine, the compressor being composed of a cast titanium alloy that has a nominal composition comprising about 5.5 to 6.63 mass percent aluminum, about 3.5 to 4.5 mass percent vanadium, about 1.0 to about 2.5 mass percent chromium, maximum of 0.50 mass percent iron, about 0.06 to about 0.12 mass percent silicon; and impurities of up to about 0.08 mass percent carbon, up to about 0.08 mass percent manganese, up to about 0.04 mass percent nitrogen, and up to about 0.013 mass percent hydrogen, and the balance titanium.

11. A method comprising:

casting a turbocharger compressor wheel that comprises a hub, a base, and a plurality of aerodynamically contoured blades using a titanium alloy that has a nominal composition comprising about 5.5 to 6.63 mass percent aluminum, about 3.5 to 4.5 mass percent vanadium, about 1.0 to about 2.5 mass percent chromium, maximum of 0.50 mass percent iron, about 0.06 to about 0.12 mass percent silicon, and at least 80 mass percent titanium;

hot isostatic pressing the compressor wheel;

heating the compressor wheel to a temperature above the β-transus temperature of the titanium alloy so that the compressor wheel has a substantially β-phase crystal microstructure; and cooling rapidly the compressor wheel from a temperature above the β-transus temperature of the titanium alloy to a temperature below the β-transus temperature at a cooling rate sufficient to provide the compressor wheel with a bi-lammellar microstructure that comprises primary a platelets and secondary α platelets in a β lamellae matrix.

12. The method of claim 11, wherein casting the turbocharger compressor wheel comprises investment casting the turbocharger compressor wheel.

13. The method of claim 11, wherein hot isostatic pressing the compressor wheel comprises hot isostatic pressing the article for about two to about four hours at a temperature of about 885° C. to about 913° C. at a pressure of not less than 1000 bar.

14. The method of claim 11, wherein, hot isostatic pressing the compressor wheel comprises hot isostatic pressing the article for about two to about four hours at a temperature of about 940° C. to about 968° C. at a pressure of not less than 1000 bar.

15. The method of claim 11, wherein heating the compressor wheel comprises heating the compressor wheel in a gas-fired furnace, and wherein cooling rapidly the compressor wheel comprises purging the gas-fired furnace with high pressure argon gas.

16. The method of claim 11, further comprising:

annealing the compressor wheel after rapid cooling.

17. The method of claim 16, wherein annealing the compressor wheel comprises annealing the compressor wheel at about 550° C. for about eight hours.

* * * * *